United States Patent [19]

Lang

[11] Patent Number: 4,767,366

[45] Date of Patent: Aug. 30, 1988

[54] WATER RAM SCOOP FOR COOLING WATER INTAKE

[75] Inventor: William P. Lang, Oshkosh, Wis.

[73] Assignee: Brunswick Corporation, Skokie, Ill.

[21] Appl. No.: 35,039

[22] Filed: Apr. 6, 1987

[51] Int. Cl.[4] ..... B63H 21/38

[52] U.S. Cl. ..... 440/76; 440/88

[58] Field of Search ..... 440/76, 78, 88; 123/195 P

[56] References Cited

U.S. PATENT DOCUMENTS

| | | | |
|---|---|---|---|
| 3,066,639 | 12/1962 | Kiebhaefer | 440/88 |
| 3,240,181 | 3/1966 | Chandler et al. | 440/88 X |
| 4,392,779 | 7/1983 | Bloemers et al. | 415/141 |

FOREIGN PATENT DOCUMENTS 30691 2/1982 Japan .

*Primary Examiner*—Sherman D. Basinger

*Attorney, Agent, or Firm*—Andrus, Sceales, Starke & Sawall

[57] ABSTRACT

A marine propulsion system (10) with a depending gear case (20) having water inlet openings (28) is provided with water intake scoops (44) for increasing the flow of water to a water pump (16). Each scoop (44) is provided with a water-receiving opening (46) leading to a passage (52) provided therein for passing water through the scoop toward the water pump. The head portion (48) of each scoop protrudes from the gear case (20), and the water-receiving opening (46) is spaced outwardly from the gear case (20) to provide an active water pickup from the flow of water past the gear case (20).

8 Claims, 2 Drawing Sheets

WATER RAM SCOOP FOR COOLING WATER INTAKE

BACKGROUND AND SUMMARY

This invention relates to water inlets in a marine propulsion gear case for supplying cooling water to the water pump for cooling the engine.

Conventional gear case water inlets are provided by holes in the gear case through which water is supplied to the water pump. In some applications, conventional water inlets are not capable of supplying sufficient pressure and water flow. Insufficient pressure and flow may be caused by frothy or aerated water, typically due to obstructions on the bottom of the boat or to a high mounting of the engine on the transom, resulting in ventilation from the surface.

The present invention provides a water intake designed to provide an increased flow of water to the water pump. The water intake in accordance with the invention provides positive water pressure and increased flow to the water pump, while having little effect on boat speed due to increased drag. The water intake of the invention protrudes from the gear case and has an opening spaced outwardly therefrom adapted to receive water. The opening forces the water into the conventional gear case holes and to the water pump. The water intake of the invention is particularly well suited for mounting on a gear case having conventional cast-in water inlet holes.

Because of the increased water flow provided by the invention, the motor can be mounted higher on the transom than normal and still be supplied with a sufficient amount of cooling water. The raising of the motor is desirable because it enables increased boat speed.

BRIEF DESCRIPTION OF THE DRAWINGS PRIOR ART

FIG. 1 is a partially broken away side view of an outboard marine engine and depending gear case showing placement of water inlets.

FIG. 2 is an enlarged isolated perspective view of water inlets provided in the marine gear case of FIG. 1 U.S. Pat. No. 4,752,257.

FIG. 3 is an exploded perspective view of water intake means shown in U.S. Pat. No. 4,752,257 issued June 21, 1988.

DETAILED DESCRIPTION

Description of the Prior Art

Figure 1:
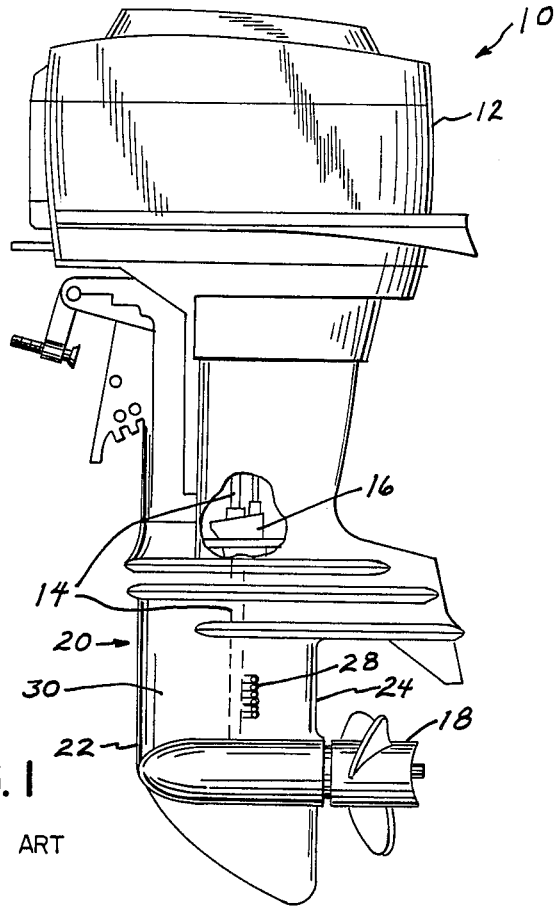
FIG. 1 PRIOR ART

FIG. 1 shows a marine propulsion system including an outboard engine 10, similarly to FIG. 1 of U.S. Pat. No. 4,392,779, incorporated herein by reference. Outboard engine 10 includes a liquid cooled power head 12 that powers a drive shaft 14 and is cooled by water supplied by a water pump 16. Rotation of drive shaft 14 drives a propeller 18 and also drives water pump 16, all as is well known.

Figure 3:
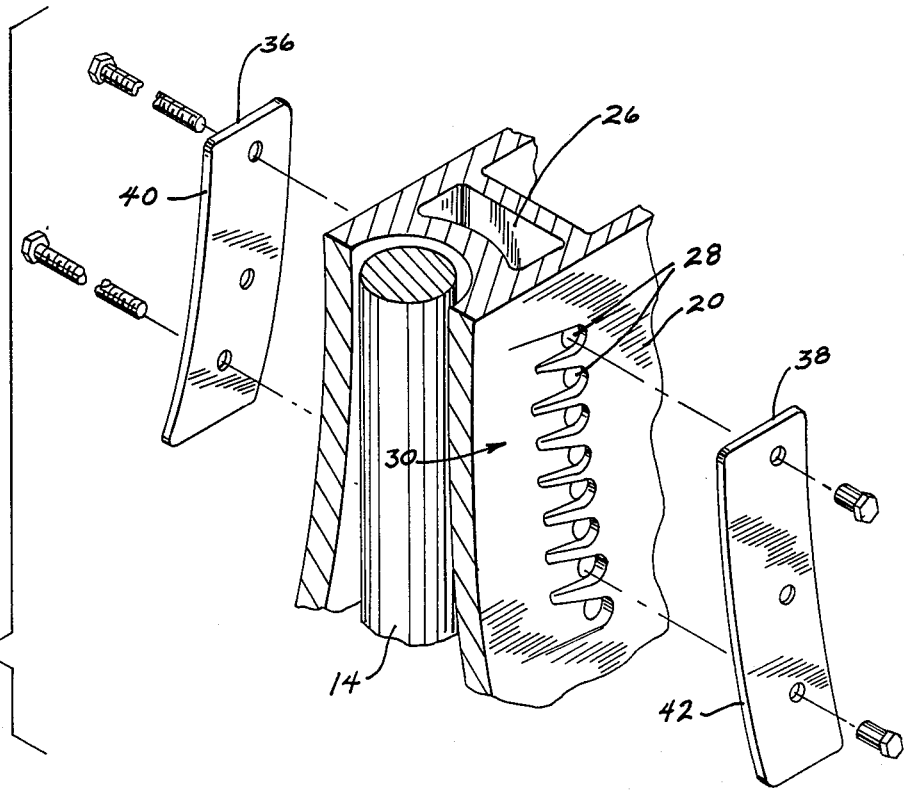

Outboard engine 10 has a depending gear case 20 with a forward leading edge 22 and a rearward trailing edge 24. A transverse passage 26, FIG. 3, is provided therebetween which communicates with water pump 16. Gear case 20 has a set of one or more water inlet openings 26 provided on each side. Water inlet openings 28 communicate with transverse passage 26 for supplying water to water pump 16. Each side of gear case 20 has a section 30 tapered inwardly and rearwardly toward the one or more water inlet openings 28.

Figure 2:
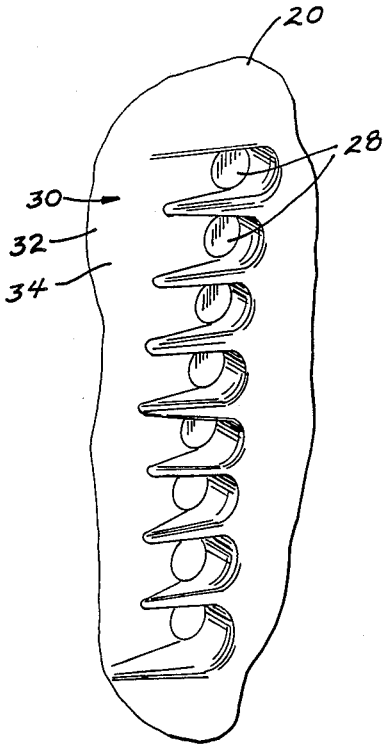
FIG. 2 PRIOR ART

FIG. 2 shows one embodiment of water inlet openings 28. Openings 28 are die cast into gear case 20 during its formation. Tapered section 30 has a forward portion 32 of least taper and a rearward portion 34 of greatest taper. Inlet openings 28 are at the rearward end of rearmost tapered portion 34. Water is drawn into openings 28 in response to low pressure areas created by openings 28 when water flows thereby.

Description of U.S. Pat. No. 4,752,257

As shown in FIG. 3, U.S. Pat. No. 4,752,257 shows a structure for increasing the flow of water into inlet holes 28. Water intake plates 36 and 38 cover the water inlet openings 28. Plates 36 and 38 have forward lips 40 and 42 spaced forwardly and outwardly of water inlet openings 28, and outwardly of tapered gear case section 30 leading to openings 28. Water intake plates 36 and 38 define with gear case 20 entrance cavities around water inlet openings 28, trapping water and directing it inwardly into openings 28 and to transverse passage 26.

Description of the Invention

Figure 4:
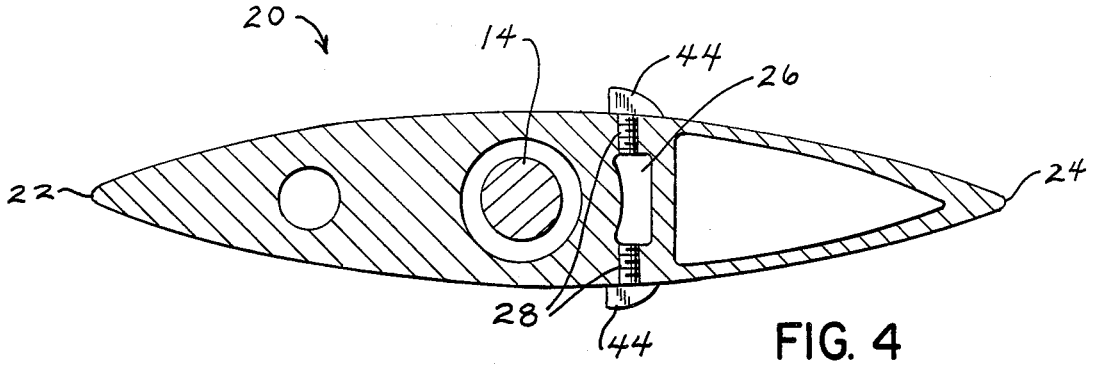
FIG. 4 is an enlarged partial sectional view through a depending gear case of an outboard marine engine showing water intake means in accordance with the invention.
Figure 5:
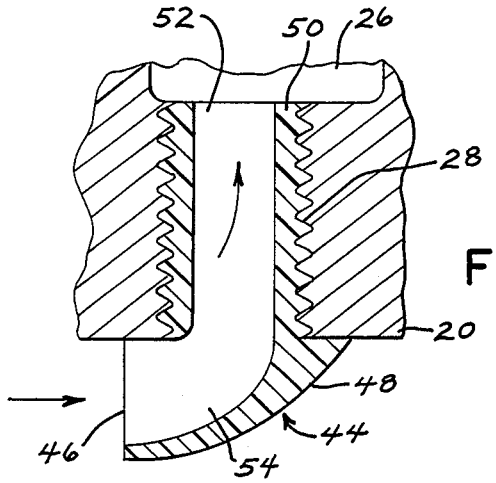
FIG. 5 is an enlarged sectional view of the water intake means shown in FIG. 4.
Figure 6:
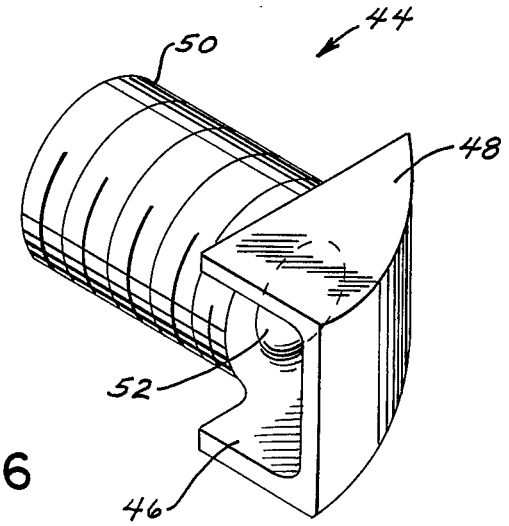
FIG. 6 is a perspective view showing the water intake means of the present invention.

FIGS. 4–6 show water intake means in accordance with the invention, and like reference numerals are used from FIGS. 1–3 where appropriate to facilitate clarity. A water intake scoop 44 is provided on each side of gear case 20. Intake scoops 44 protrude from gear case 20, and have a water-receiving opening 46 spaced outwardly therefrom. Water-receiving opening 46 is adapted to receive water and direct water inwardly toward transverse passage 26 for supply to water pump 16. Water-receiving opening 46 is spaced forwardly of the forward most point of water inlet 28.

Each scoop 44 is provided with a head portion 48 and a shank portion 50. Water-receiving opening 46 is provided in the front face of head portion 48. The front face of head portion 48, containing opening 46, is substantially perpendicular to the direction of water flow past gear case 20.

Shank portion 50 of scoop 44 is adapted to mate with water inlet openings 28. In the embodiment shown in FIGS. 4–6, water inlet opening 28 is threaded, and shank portion 50 is provided with threads to mate with those provided in inlet opening 28. Scoop 44 is then threaded into gear case 20 until it is bottomed out on gear case 20, so that opening 46 faces forwardly toward forward leading edge 42.

Shank portion 48 of scoop 44 is provided with an axial passage 52, which communicates with a hollow curved interior portion 54 of head 48, leading to opening 46. A passage is thereby provided through scoop 44 for water to pass from opening 46 to transverse passage 26 for supply to water pump 16. Hollow curved interior 54 of head 48 provides a smooth flow of water from opening 46 to shank passage 52.

Scoops 44 provide a more active pickup of water than previous structures. In prior art structures, water is passively directed into water inlet openings 28 by the low pressure area created when water flows past openings 28. With installation of scoops 44, water pickup is actively accomplished by the projection of head 48 of scoop 44 into the water flow. This feature of the invention aggressively forces water into inlet openings 28.

Depending on the particular application, only as many scoops as are needed to supply sufficient water to water pump 16 need be installed in inlet openings 28. If less than all of inlet openings 28 require scoops to provide sufficient flow, the remainder of openings 28 can be left as is to provide a passive supply of water.

Scoops 44 provide a relatively low cost solution to the problem of supplying adequate water flow and pressure to pump 16, and are easily installed in gear case 20.

It is recognized that various equivalents, alternatives and modifications are possible within the scope of the appended claims.

I claim:

1. In a marine propulsion system having a depending gear case with one or more water inlet openings on the side of said gear case for supplying water to a water pump, water intake means protruding from said gear case and having a water-receiving opening spaced outwardly therefrom adapted to receive water as it flows past said gear case and to direct such water inwardly into one or more of said water inlet openings for increasing water flow to said water pump, said water intake means having a shank portion through which said received water flows, said shank portion extending into said gear case for attaching said water intake means thereto.

2. The invention according to claim 1, wherein the plane of said water-receiving opening in said water intake means is substantially perpendicular to the flow of water past said gear case.

3. The invention according to claim 1, wherein said water-receiving opening of said water intake means is spaced forwardly of said one or more water inlet openings.

4. The invention according to claim 1, wherein said water intake means comprises a scoop attached to said gear case and protruding therefrom, said scoop having a head portion provided with said water-receiving opening adapted to receive water as it flows past said gear case and to direct such water inwardly into one or more of said water inlet openings.

5. The invention according to claim 4, wherein said water-receiving opening in said head portion of said scoop opens into a curved passage formed in the interior of said head portion for providing smooth flow of water from said water-receiving opening into said water inlet openings in said gear case.

6. In a marine propulsion system having a depending gear case with one or more water inlet openings on the side of said gear case for supplying water to a water pump, water intake means comprising one or more scoops protruding from said gear case at one or more of said water inlet openings, each said scoop having a water-receiving opening therein spaced outwardly from said gear case and adapted to receive water as it flows past said gear case and to direct such water inwardly into said one or more water inlet openings for increasing water flow to said water pump, said one or more scoops each having a shank portion through which said received water flows, said shank portion extending into said gear case for attaching said one or more scoops thereto.

7. The invention according to claim 6, wherein each said scoop is individually connected to said gear case at one of said water inlet openings, and wherein each said scoop has a head portion provided with said water-receiving opening and wherein said shank portion has a passage in communication with said water-receiving opening for allowing water to pass through said scoop and said water inlet opening in said gear case and to said water pump.

8. The invention according to claim 7, wherein said water inlet openings are threaded through said gear case, and wherein said shank portion of each said scoop is provided with mating threads for connection of said scoops to said gear case.

* * * * *